United States Patent [19]

Dewees

[11] Patent Number: 4,635,932

[45] Date of Patent: Jan. 13, 1987

[54] ANKLE AND LOWER LEG EXERCISER FOR PROPRIOCEPTIVE REHABILITATION

[75] Inventor: James A. Dewees, Wichita, Kans.

[73] Assignee: Cerebral Palsy Research Foundation of Kansas, Inc., Wichita, Kans.

[21] Appl. No.: 722,606

[22] Filed: Apr. 12, 1985

[51] Int. Cl.[4] ..... A63B 23/04

[52] U.S. Cl. ..... 272/96; 272/146

[58] Field of Search ..... 272/111, 146, 96, 78, 272/54, 110

[56] References Cited

U.S. PATENT DOCUMENTS 478,166 7/1892 Madsen ..... 272/146

FOREIGN PATENT DOCUMENTS 1372342 10/1974 United Kingdom ..... 272/146

2004190 3/1979 United Kingdom ..... 272/146

*Primary Examiner*—Richard J. Apley

*Assistant Examiner*—H. Macey

*Attorney, Agent, or Firm*—Edwin H. Crabtree

[57] ABSTRACT

An ankle and lower leg exerciser for use in the strengthening and proprioceptive training of an ankle and lower leg. The exerciser having an oval-shaped table adjustable in height and specifically designed to enhance and limit specific ranges of motion of the ankle thereby promoting and preventing normal and abnormal stresses.

3 Claims, 4 Drawing Figures

ANKLE AND LOWER LEG EXERCISER FOR PROPRIOCEPTIVE REHABILITATION

BACKGROUND OF THE INVENTION

This invention relates to an ankle and lower leg exerciser and more particularly but not by way of limitation to an exerciser designed for the purpose of stretching, strengthening and improving the coordination and proprioceptive abilities during the rehabilitation process following an injury.

Heretofore, there have been various types of exercising devices, pivotal turn tables and related equipment such as the following devices described in U.S. Pat. No. 2,256,001 to Titus, U.S. Pat. No. 2,714,007 to Jordan, U.S. Pat. No. 3,612,520 to Chang, U.S. Pat. No. 3,713,653 to Romans, U.S. Pat. No. 3,984,100 to Firster, U.S. Pat. No. 4,270,749 to Hebern. None of the abovementioned exercising devices provide the unique features and advantages for proprioceptive rehabilitation of an ankle and lower leg.

SUMMARY OF THE INVENTION

The subject ankle and lower leg exerciser provides for anatomical accomodation in ankle stretching, strengthening and patient proprioceptive training.

Through the continued use of the exerciser, coordination and proprioceptive abilities are greatly improved during the rehabilitation process following an injury.

The invention provides for the protection of abnormal stress to various ranges of motion to prevent further damage during an exercise program. The exerciser provides resistance in various ranges of motion which are necessary to stimulate strengthening of the muscles and to provide shock absorbency throughout and at the end of the movement.

An adjustable height feature allows for the control of progression from a lesser to a greater degree of range of motion which is an important factor during the rehabilitation process.

By relearning the process of proprioception, the brain is able to know the approximate position of the ankle or lower leg in space, which is extremely important in preventing further occurences of the injury by improving balance and reflex response.

The exerciser can be used for rehabilitation of orthopedic, neuromuscular and neurological disorders allowing for a safe and anatomically correct means of exercise.

The ankle and lower leg exerciser for proprioceptive rehabilitation includes a base adapted for receipt on a floor. A foot table is adjustably mounted on top of the base. The table is oval in shape having a forward or toe portion, a rear or heel portion and assuming use with the right foot for example, a right side portion and a left side or arch portion. The left side or arch portion has a length greater than the right side portion for governing the lesser range of motion in this direction. The oval-shaped table is mounted upon a rubber bushing assembly which allows the table to tilt in a limited range of motion on top of the base.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
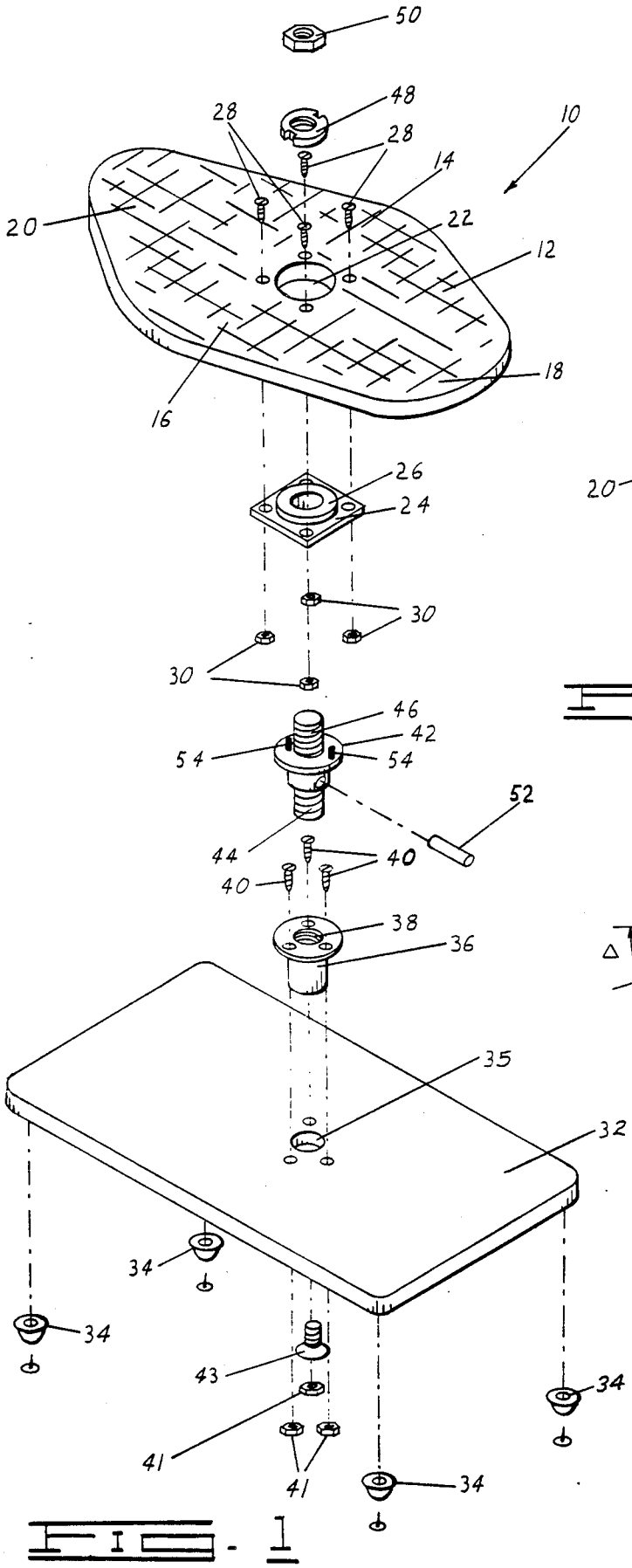
FIG. 1 is an exploded view of the ankle and lower leg exerciser.

In FIG. 1 the ankle and lower leg exerciser is designated by general reference numeral 10. The exerciser 10 includes an oval-shaped table 12 having a forward or toe portion 14, a rear or heel portion 16, a right side portion 18 and a left side or arch portion 20. The arch portion 20 has a greater length than the right side portion 18. The oval-shaped table 12 includes an aperture 22 through the center thereof for receiving a mounting plate 24 having a rubber bushing 26 therein. The mounting plate 24 is secured to the table 12 by a plurality of screws 28 and nuts 30.

A rectangular-shaped base 32 is used for receiving the oval-shaped table on top thereof. The base 32 includes a plurality of rubber bumpers 34 which are received on top of a floor. The base 32 includes an aperture 35 therethrough for receiving a base flange 36 having a threaded aperture 38 therethrough. The flange 36 is connected to the base 32 using a plurality of screws 40 and nuts 41. A table flange 42 having a threaded lower post 44 and an upper threaded post 46 is used for securing the oval-shaped table 12 on top of the base 32. The lower threaded post 44 is threaded inside the threaded aperture 38 of the base flange 36. The upper threaded post 46 is received through the rubber bushing 26 and secured to the top of the table 12 using a table plate 48 and jam nut 50. Resistance to tilt of the table 12 is inversely proportional to distance set between the table plate 48 and the table flange 42 the table 12 through the use of the resilient rubber bushing 26 tilts on the stationary upper post 46. By rotating the oval-shaped table 12 in a counter clockwise direction the table 12 is raised with the lower post 44 threaded upwardly in the threaded aperture 38 of the base flange 36. In turn, by rotating the oval-shaped table 12 in a clockwise manner, the lower post 44 is threaded inwardly or downwardly into the base flange 36 thereby lowering the table 12 on top of the base 32. A roll pin 52 is used for securing the lower threaded post 44 and upper threaded post 46 to the table flange 42. A threaded cap screw or stop 43 is used to limit the height adjustment in the lower post 44. Further, a pair of machine screws 54 are used to connect the table flange 42 to the bottom of the rubber bushing 26.

Figure 2:
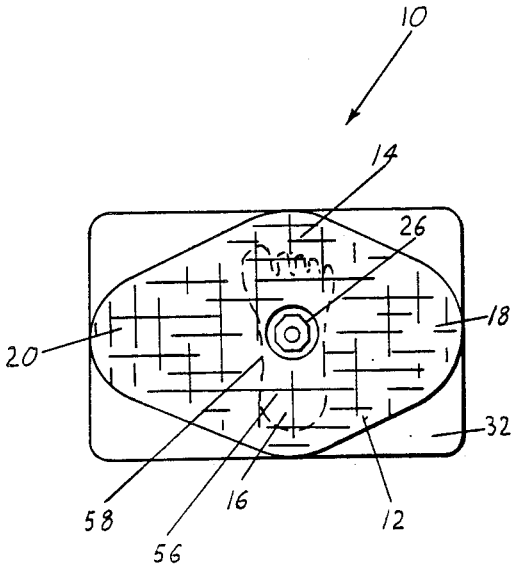
FIG. 2 is a top view of the exerciser.

In FIG. 2 a top view of the oval-shaped table 12 can be seen disposed above the floor mounted base 32. Also shown in this view is the top view of a foot 56 shown in dotted lines with an arch 58 of the foot 56 pointed toward the arch portion 20 of the table 12. As mentioned earlier in the discussion of the exerciser 10, the oval-shaped table 12 through its specific design is used to enhance or limit specific ranges of motion of the ankle, therefore promoting or preventing normal and abnormal stresses. In other words, the anatomical movements such as dorsiflexion or heel movement would be movement toward the rear portion 16 of the table 12. Further, movement of plantarflexion provides for limited toe movement or toward the toe portion 14 of the table. Likewise, limited motion is provided for supination or inversion which is outward movement toward the right side portion 18 of the table 12. Further, and more importantly, pronation or eversion provides for limited motion toward the arch or left side portion 20 of the table 12.

Figure 3:
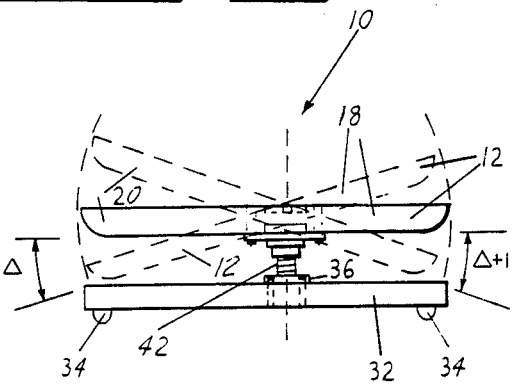
FIG. 3 is a front view of the exerciser with movement to the left and right side shown in dotted lines.

In FIG. 3 a front view of the table 12 can be seen shown in solid and dotted lines with the oval-shaped table raised and lowered on the right side portion 18 and the arch or left side portion 20. Resistance to the movement of the oval-shaped table 12 is provided by the rubber bushing 26 in the mounting plate 24 which theoretically is situated in an anatomical center of the table 12 which is in effect the center of gravity of the body of the patient. The resistance to the movement of the table 12 above the base 32 stimulates the strengthening of muscle and provides shock absorbency in the table's movement above the base 32. It should be noted by the specific design of the oval-shaped table 12, for example in FIG. 3, the range or angle movement to the left or arch side portion 20, is a degree shown as $\Delta$. While the right side portion 18 having a shorter length and an increased angle of $\Delta+1$ before the edge of the right side portion 18 engages the top of the base 32. As the patient increases his range of motion, height adjustment may be increased by rotating the table 12 in a counter clockwise direction which raises the table 12 upwardly above the base flange 36.

Figure 4:
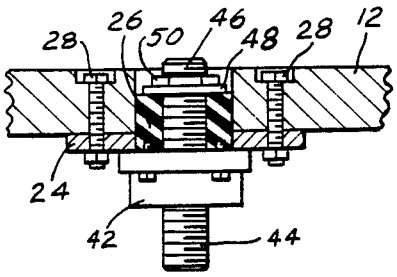
FIG. 4 illustrates an enlarged sectional view of a rubber bushing and a table flange secured to a foot table of exerciser.

In FIG. 4 a cross-sectional view of the mounting plate 24 with rubber bushing 24 is shown with the rubber bushing received inside a portion of the foot table 12. The upper post 46 is received through the rubber bushing 26 and secured to the mounting plate 24 using the table plate 48 and nut 50. The table 12 tilts due to the resilience of the rubber bushing 26 bearing against the sides of the upper post 46.

The ankle and lower leg exerciser 10 is designed for the purpose of strengthening, stretching and improving coordination and proprioceptive abilities during the rehabilitation process following an injury. During the rehabilitation process of an injured ankle or lower leg, protection from abnormal stresses into various ranges of motion is very important to prevent further damage. Using the oval-shaped table 12 with its resistance to movement, various ranges of motion stimulates strengthening of the muscles and provides shock absorbency throughout and at the ends of the movement. The provision of adjusting the height of the table allows for the control of progression from a lesser to a greater degree of range of motion which is also an important factor during the rehabilitation process. Proprioception or coordination retraining and conditioning is an absolute must during the rehabilitation of an ankle of lower leg. By the relearning process of proprioception, the brain is now able to approximately know where the ankle or lower leg is in space which is very important in regard to preventing further occurence of the injury.

Changes may be made in the construction and arrangement of the parts or elements of the embodiments as described herein without departing from the spirit or scope of the invention defined in the following claims.

What is claimed is:

1. An ankle and lower leg exerciser, the exerciser comprising:

a base adapted for receipt on a floor, the base including a base flange having a threaded aperture therein;

an oval-shaped foot table having an aperture through the center thereof for receiving a mounting plate attached thereto, the mounting plate having a rubber bushing therein; and a table flange having an upper post and a lower post, the lower post threadably received in the threaded aperture of the base flange for adjusting the height of the table above the base, the upper post received through the rubber bushing and attached to the mounting plate, the rubber bushing allowing, through its resilience, limited movement of the table against the upper post, the table having a forward or toe portion, a rear or heel portion, a right side portion and a left side or arch portion.

2. The exerciser as described in claim 1 wherein the toe portion and heel portion have a length less than the arch portion and right side portion so the arch portion and the right side portion do not have as great an angle of motion as the toe and heel portions.

3. The exerciser as described in claim 1 wherein the arch portion has a length greater than the right side portion so the arch portion does not have as great an angle of motion.

* * * * *